US011230821B2

(12) United States Patent
Kanazawa et al.

(10) Patent No.: US 11,230,821 B2
(45) Date of Patent: Jan. 25, 2022

(54) CONSTRUCTION MACHINE

(71) Applicant: HITACHI CONSTRUCTION MACHINERY CO., LTD., Tokyo (JP)

(72) Inventors: Akira Kanazawa, Tokyo (JP); Hidekazu Moriki, Tokyo (JP); Shinya Imura, Tsuchiura (JP); Yasutaka Tsuruga, Tsuchiura (JP); Takaaki Chiba, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 17/268,717

(22) PCT Filed: Jul. 11, 2019

(86) PCT No.: PCT/JP2019/027520
§ 371 (c)(1),
(2) Date: Feb. 16, 2021

(87) PCT Pub. No.: WO2020/066225
PCT Pub. Date: Apr. 2, 2020

(65) Prior Publication Data

US 2021/0317636 A1 Oct. 14, 2021

(30) Foreign Application Priority Data

Sep. 28, 2018 (JP) ..... JP2018-183430

(51) Int. Cl.
*E02F 9/22* (2006.01)
*F15B 11/028* (2006.01)
(Continued)

(52) U.S. Cl.
CPC ..... *E02F 9/2228* (2013.01); *E02F 9/2235* (2013.01); *F15B 11/028* (2013.01);
(Continued)

(58) Field of Classification Search
CPC ..... F15B 11/028; F15B 11/042; F15B 11/044; F15B 2211/351; F15B 2211/353; E02F 9/2228; E02F 9/2235
See application file for complete search history.

(56) References Cited

U.S. PATENT DOCUMENTS 8,321,114 B2 * 11/2012 Kamado ..... E02F 9/264 701/84
9,309,650 B2 * 4/2016 Nagato ..... G07C 5/0808
(Continued)

FOREIGN PATENT DOCUMENTS

JP 06-117408 A 4/1994
WO 2015-137525 A 9/2015

OTHER PUBLICATIONS

International Search Report of PCT/JP2019/027520 dated Sep. 24, 2019.

(Continued)

*Primary Examiner* — Thomas E Lazo
(74) *Attorney, Agent, or Firm* — Mattingly & Malur, PC

(57) ABSTRACT

A construction machine that precisely enables derivation of the operation characteristics of hydraulic actuators in a high-velocity area with less calibration operation is provided. A controller (10) has a calibration mode in which the controller (10) derives operation characteristics ($\alpha(xs)$) representing a relation among a spool position (xs) of a meter-in valve (8*a*1), an operation velocity (Va) of a hydraulic actuator (4*a*), and a differential pressure ($\Delta P$) across the meter-in valve (8*a*1), and is configured to, in a case where the spool position (xs) of the meter-in valve (8*a*1) has changed in a direction to increase the opening area of the meter-in valve (8*a*1) in the calibration mode, output a command signal to increase the opening area of a bleed-off valve (8*b*1) to a bleed-off solenoid proportional pressure-
(Continued)

reducing valve (**8*b*2**) as a command signal to reduce the differential pressure (ΔP).

5 Claims, 11 Drawing Sheets

(51) Int. Cl.
*F15B 11/042* (2006.01)
*F15B 11/044* (2006.01)
*F15B 19/00* (2006.01)

(52) U.S. Cl.
CPC ..... *F15B 11/042* (2013.01); *F15B 11/044* (2013.01); *F15B 19/002* (2013.01); *F15B 2211/20546* (2013.01); *F15B 2211/351* (2013.01); *F15B 2211/353* (2013.01)

(56) References Cited

U.S. PATENT DOCUMENTS

| | | | | |
|---|---|---|---|---|
| 9,458,597 | B2 * | 10/2016 | Ikegami | F15B 11/17 |
| 9,598,841 | B2 * | 3/2017 | Ikegami | E02F 9/2271 |
| 10,975,551 | B2 * | 4/2021 | Uji | G07C 5/02 |
| 2016/0138240 | A1 | 5/2016 | Ikegami et al. | |

OTHER PUBLICATIONS

International Preliminary Report on Patentability received in corresponding International Application No. PCT/JP2019/027520 dated Apr. 8, 2021.

* cited by examiner

CONSTRUCTION MACHINE

TECHNICAL FIELD

The present invention relates to a construction machine such as a hydraulic excavator.

BACKGROUND ART

In recent years, along with efforts being made to support information-oriented construction, there are construction machines such as hydraulic excavators having the machine control functionality of controlling the position and posture of a work mechanism such as a boom, an arm or a bucket such that the work mechanism moves along a target construction surface. As a known representative example of those construction machines, there has been known a construction machine that limits the operation of a work mechanism such that the bucket tip does not move ahead further when the bucket tip gets close to a target construction surface.

Engineering works construction management standards specify standard values of tolerated precision about target construction surfaces in the height direction. In a case where the precision of a finished form of a construction surface exceeds a tolerated value, it becomes necessary to redo the construction, and thereby the work efficiency deteriorates. Accordingly, the machine control functionality is demanded to have control precision that is necessary for satisfying the tolerated precision of finished forms.

In order to control the position and posture of a work mechanism precisely, it is necessary to accurately know the operation characteristics of hydraulic actuators. The operation characteristics of actuators are affected by the installation positions of pressure sensors, and computation errors of relations of opening areas relative to spool positions (opening characteristics). Accordingly, for more accurate derivation of the operation characteristics, the operation characteristics are desirably derived from measurement data that is obtained when hydraulic excavators are actually caused to operate.

As techniques to derive the operation characteristics of hydraulic actuators, Patent Document 1 discloses a construction machine control system, a construction machine and a construction machine control method that enable derivation of the operation characteristics of hydraulic cylinders. A hydraulic excavator control system illustrated in Patent Document 1 has a deriving section that derives the operation characteristics of actuators. The deriving section acquires measurement data by actually causing the hydraulic excavator to operate, and derives the operation characteristics of the actuators on the basis of the measurement data.

PRIOR ART DOCUMENT

Patent Document

Patent Document 1: PCT Patent Publication No. WO2015/137525

SUMMARY OF THE INVENTION

Problem to be Solved by the Invention

The "deriving section" in Patent Document 1 performs direct mapping of relations between the spool positions of meter-in valves and actuator velocities as operation characteristics. Because of this, when measurement data in a high-velocity area of the actuator velocities is to be acquired, the actuators are required to be actually moved at high velocities. Mapping is performed by using velocities at the steady state as true values, but in a case where the actuators are moved at high velocities, high accelerations occur more easily, and the influence of the inertia due to link motion and the viscous resistance of a hydraulic fluid become dominant. Accordingly, it becomes difficult to accurately map velocities at the steady state relative to the spool positions of the meter-in valves. In addition, actual hydraulic excavators have movable ranges. Accordingly, it is difficult to acquire data in a high-velocity area by calibration operation performed only once, and it is necessary to suspend calibration to correct the posture of a hydraulic excavator.

One of possible solutions to the problems described above is to gradually accelerate an actuator by setting the acceleration of the spool to be low at the time of calibration operation. However, if the spool is accelerated for a long time, the limit of the movable range of the actuator is exceeded. Accordingly, there is a limit of the minimum value of the acceleration, and it is difficult to eliminate the influence of the inertia of the actuator and the viscous resistance of the hydraulic fluid in a high-velocity area.

The present invention has been made in view of the problems described above, and an object of the present invention is to provide a construction machine that allows precise derivation of the operation characteristics of hydraulic actuators in a high-velocity area with less calibration operation.

Means for Solving the Problem

In order to achieve the object described above, the present invention provides a construction machine including: a prime mover; a tank that stores a hydraulic operating fluid; a hydraulic pump that is driven by the prime mover, and delivers, as a hydraulic fluid, the hydraulic operating fluid sucked in from the tank; a hydraulic actuator that is driven by the hydraulic fluid delivered from the hydraulic pump; a meter-in valve that adjusts a flow rate of the hydraulic fluid supplied from the hydraulic pump to the hydraulic actuator; a meter-in spool position adjusting device that adjusts a spool position of the meter-in valve; and a controller that outputs a command signal to the meter-in spool position adjusting device. The construction machine includes: a velocity sensor for sensing an operation velocity of the hydraulic actuator; a meter-in spool position sensor that senses the spool position of the meter-in valve; a pressure sensor that senses a differential pressure across the meter-in valve; and a pressure adjusting device that adjusts the differential pressure across the meter-in valve. The controller has a calibration mode in which the controller derives operation characteristics that represent a relation among the spool position of the meter-in valve, the operation velocity of the hydraulic actuator, and the differential pressure across the meter-in valve, and is configured to, in a case where the spool position of the meter-in valve has changed in a direction to increase an opening area of the meter-in valve in the calibration mode, output a command signal to reduce the differential pressure across the meter-in valve to the pressure adjusting device such that increase in the flow rate of the hydraulic fluid to be flown into the meter-in valve is suppressed.

According to the thus-configured present invention, since the relation between the spool position of the meter-in valve and the actuator velocity is mapped indirectly by using the differential pressure across the meter-in valve, it becomes possible to perform the mapping of the operation characteristics without actually moving the actuator at a high velocity. Additionally, by adjusting the differential pressure across the meter-in valve at the time of calibration operation of deriving the operation characteristics of the hydraulic actuator, and keeping the actual velocity of the hydraulic actuator low such that the limit of the movable range of the actuator is not exceeded, the influence of the inertia of the hydraulic actuator and the viscous resistance of the hydraulic fluid that can be causes of errors of the mapping of the operation characteristics is mitigated. Thereby, it becomes possible to improve the precision of operation characteristics of hydraulic actuators in a high-velocity area with less calibration operation.

Advantages of the Invention

According to the present invention, it becomes possible, in a construction machine such as a hydraulic excavator, to improve the precision of operation characteristics of hydraulic actuators in a high-velocity area with less calibration operation.

MODES FOR CARRYING OUT THE INVENTION

Figure 1:
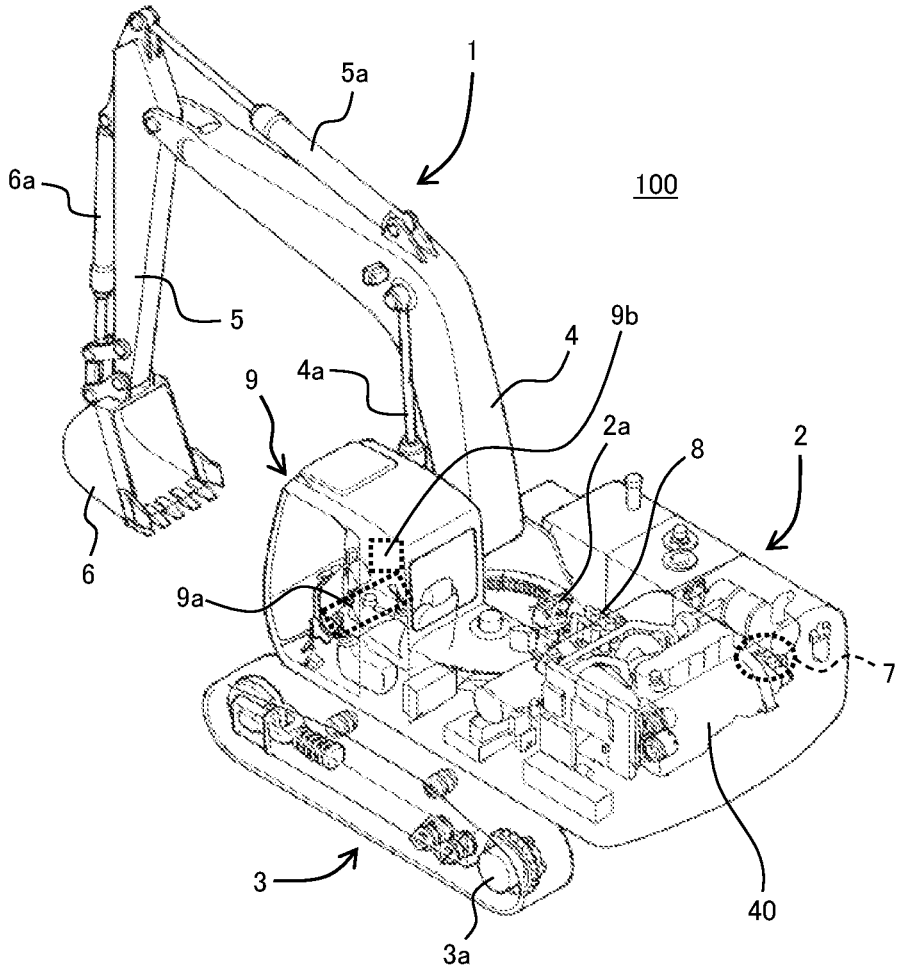
FIG. 1 is a figure schematically illustrating the external appearance of a hydraulic excavator according to a first embodiment of the present invention.

Hereinafter, as an example of a construction machine according to embodiments of the present invention, a hydraulic excavator is explained with reference to the drawings. Note that equivalent members are given the same reference characters in the drawings, and overlapping explanations are omitted as appropriate.

First Embodiment

FIG. 1 is a figure schematically illustrating the external appearance of a hydraulic excavator according to a first embodiment of the present implementation.

In FIG. 1, a hydraulic excavator 100 includes: an articulated front device (front work implement) 1 including a plurality of driven members (a boom 4, an arm 5 and a bucket (work instrument) 6) that are individually vertically pivoted, and are coupled with each other; and an upper swing structure 2 and a lower track structure 3 which configure a machine body. The upper swing structure 2 is swingably provided relative to the lower track structure 3. In addition, the base end of the boom 4 of the front device 1 is vertically pivotably supported at a front section of the upper swing structure 2, one end of the arm 5 is vertically pivotably supported at an end section (tip) of the boom 4 different from its base end, and the bucket 6 is vertically pivotably supported at the other end of the arm 5. The boom 4, the arm 5, the bucket 6, the upper swing structure 2 and the lower track structure 3 are driven by a boom cylinder 4*a*, an arm cylinder 5*a*, a bucket cylinder 6*a*, a swing motor 2*a*, and left and right travel motors 3*a* (only one travel motor is illustrated), respectively, which are hydraulic actuators. The boom cylinder 4*a*, the arm cylinder 5*a*, and the bucket cylinder 6*a* have built-in cylinder position sensors mentioned below that can measure their cylinder positions. By performing numerical differentiation of the measured cylinder positions, cylinder velocities are computed. That is, the cylinder position sensors configure a velocity sensor for sensing the operation velocities of the hydraulic actuators.

The boom 4, the arm 5 and the bucket 6 operate on a single plane (hereinafter, an operation plane). The operation plane is a plane orthogonal to the pivot axes of the boom 4, the arm 5 and the bucket 6, and can be set such that it passes through the widthwise centers of the boom 4, the arm 5 and the bucket 6.

An operation lever device (operation device) 9*a* that outputs operation signals for operating the hydraulic actuators 2*a*, 4*a*, 5*a* and 6*a* is provided in a cab 9 in which an operator gets. The operation lever device 9*a* includes an operation lever that can be inclined forward and backward, and leftward and rightward, and a sensor that electrically senses an operation signal corresponding to an inclination amount (lever operation amount) of the operation lever. The operation lever device 9*a* outputs the lever operation amount sensed by the sensor to a controller 10 which is a controller (illustrated in FIG. 2) via an electric wiring. In addition, a man-machine interface 9*b* is installed in the cab 9. The man-machine interface 9*b* displays an operation instruction and a target surface sent from an operation state display control section 10*b* mentioned below (illustrated in FIG. 2), and gives an instruction about an operation mode to a hydraulic system control section 10*c* mentioned below (illustrated in FIG. 2).

The operation control of the boom cylinder 4*a*, the arm cylinder 5*a*, the bucket cylinder 6*a*, the swing motor 2*a* and the left and right travel motors 3*a* is performed by controlling, with a control valve 8, the direction and flow rate of a hydraulic operating fluid supplied from a hydraulic pump 7 driven by an engine 40 to each of the hydraulic actuators 2*a* to 6*a*. The control of the control valve 8 is performed by drive signals (pilot pressures) output from a pilot pump 70 mentioned below via a solenoid proportional valve. By controlling the solenoid proportional valve with the controller 10 based on the operation signals from the operation lever device 9*a*, the operation of each of the hydraulic actuators 2*a* to 6*a* is controlled.

Note that the operation lever device 9*a* may be a hydraulic pilot operation lever device different from the one described above, and may be configured to supply, as drive signals to the control valve 8, pilot pressures according to operation directions and operation amounts of the operation lever operated by an operator, and drive each of the hydraulic actuators 2*a* to 6*a*.

Figure 2:
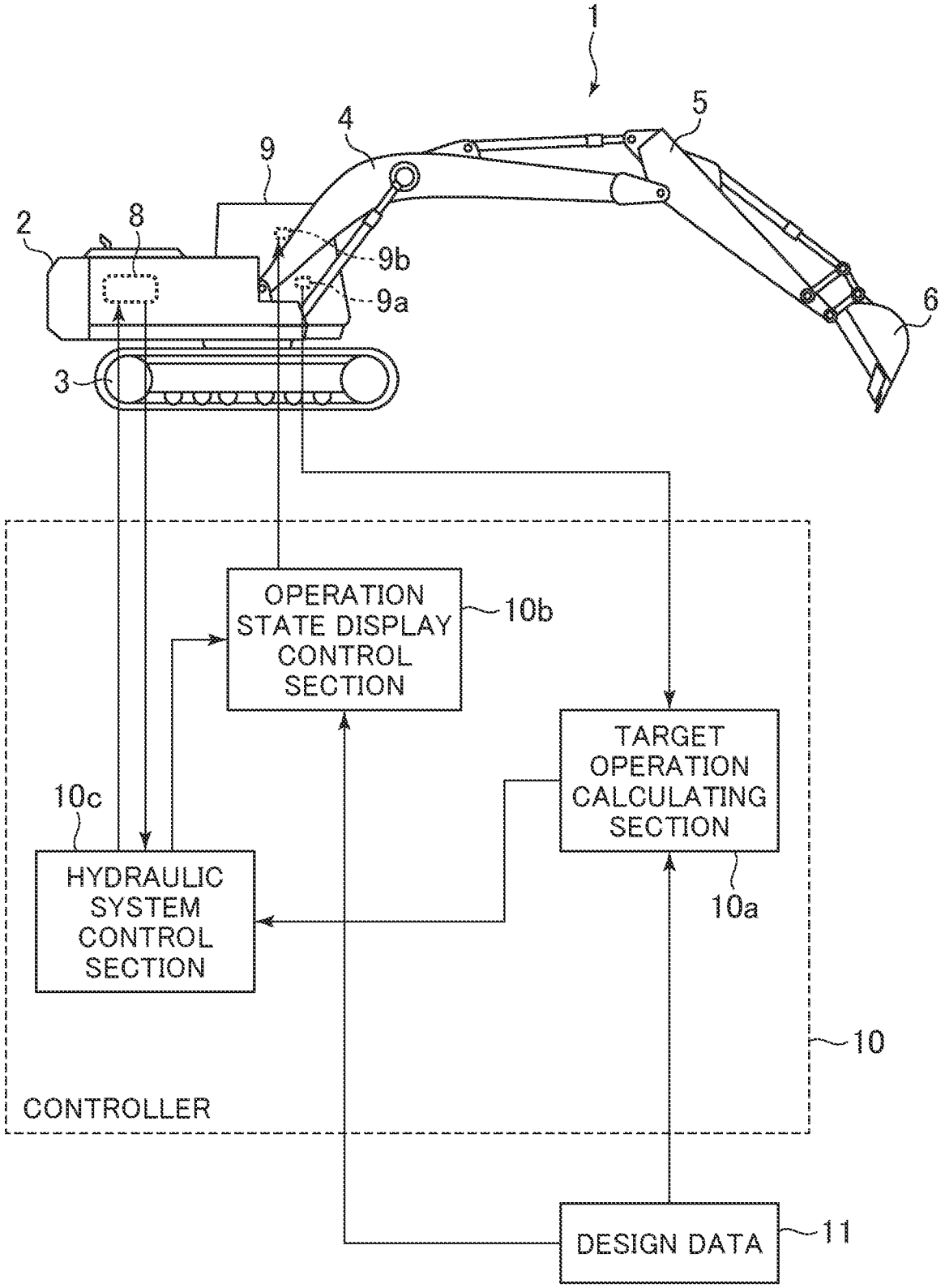
FIG. 2 is a figure schematically illustrating part of the processing functionality of a controller mounted on the hydraulic excavator illustrated in FIG. 1.

FIG. 2 is a figure schematically illustrating part of the processing functionality of the controller mounted on the hydraulic excavator 100.

In FIG. 2, the controller 10 has various functionalities for controlling the operation of the hydraulic excavator 100, and has a target operation calculating section 10*a*, the operation state display control section 10*b*, and the hydraulic system control section 10*c*.

On the basis of design data 11 such as a three-dimensional construction drawing stored in advance by a construction manager in a storage device which is not illustrated or the like, a target construction surface computed according to the design data 11, and an input through the operation lever device 9*a* operated by an operator, the target operation calculating section 10*a* calculates target operation of the machine body, and gives the hydraulic system control section 10*c* mentioned below a command about target positions of hydraulic actuators according to the target operation of the machine body.

The operation state display control section 10*b* controls display of the man-machine interface 9*b* provided in the cab 9 and the like. On the basis of the target construction surface, and postural information about the front device 1 and a bucket target velocity which are calculated at the hydraulic system control section 10*c* mentioned below, the operation state display control section 10*b* calculates an instruction content about operation assistance for the operator, and displays the instruction content on the man-machine interface 9*b* in the cab 9 or gives a sound notification about the instruction content.

That is, the operation state display control section 10*b* performs part of the functionality as a machine guidance system that assists operation performed by the operator by displaying, on the man-machine interface 9*b*, the posture of the front device 1 having driven members such as the boom 4, the arm 5 and the bucket 6, and the tip position, angle, velocity and the like of the bucket 6, for example.

The hydraulic system control section 10*c* controls the hydraulic system of the hydraulic excavator 100 including the hydraulic pump 7, the control valve 8, the hydraulic actuators 2*a* to 6*a* and the like. On the basis of target operation of each actuator calculated at the target operation calculating section 10*a*, and a measurement value of each sensor attached to the hydraulic system of the hydraulic excavator 100 mentioned below, the hydraulic system control section 10*c* calculates a control command to realize the target operation, and controls the hydraulic system of the hydraulic excavator 100. That is, the hydraulic system control section 10*c* performs part of the functionality as a machine control system that performs control of limiting the operation of the front device 1 such that portions other than the back surface of the bucket 6 do not contact the target surface, for example.

Figure 3:
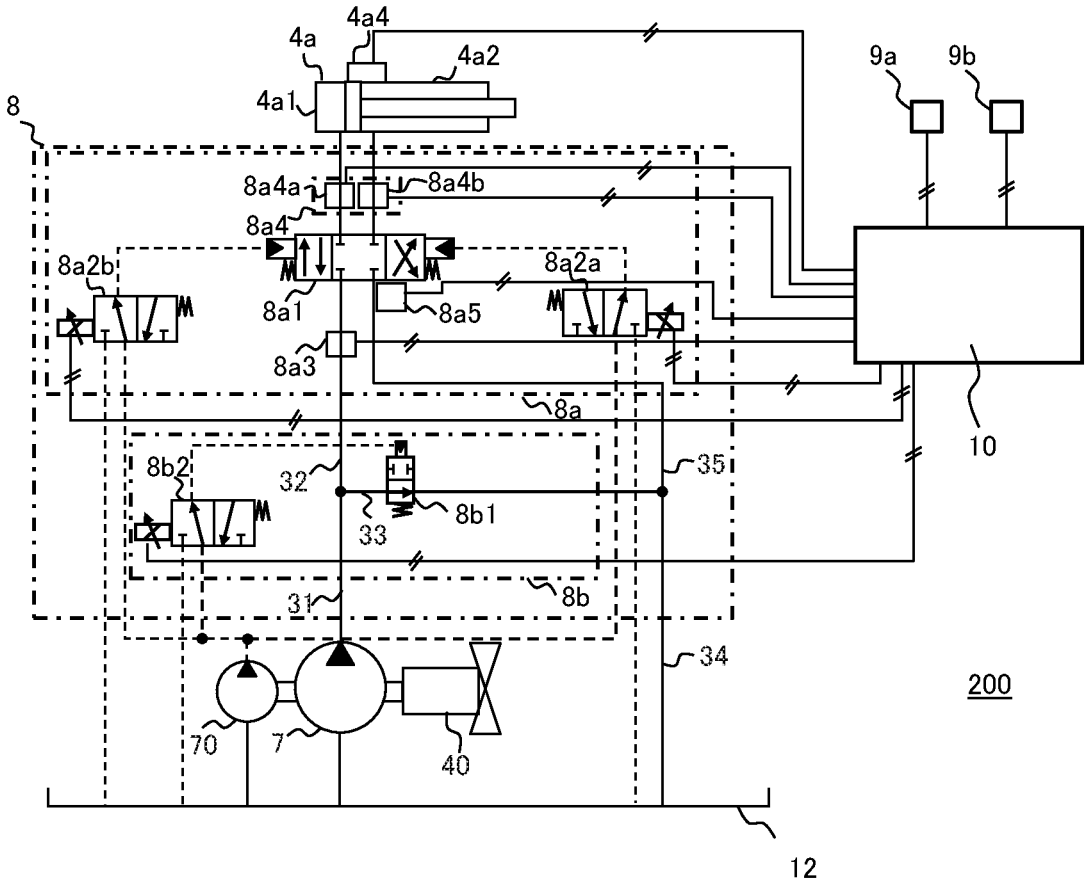
FIG. 3 is a figure schematically illustrating a hydraulic system mounted on the hydraulic excavator illustrated in FIG. 1.

FIG. 3 is a figure schematically illustrating the hydraulic system mounted on the hydraulic excavator 100. Note that only portions related to the operation of the boom 4 are illustrated in FIG. 3. The other portions related to the operation of the hydraulic actuators are similar to those for the boom 4, and thus explanations thereof are omitted.

In FIG. 3, a hydraulic system 200 includes: the control valve 8 that drives each of the hydraulic actuators 2*a* to 6*a*; the hydraulic pump 7 that supplies a hydraulic fluid to the control valve 8; the pilot pump 70 that supplies pilot pressure to hydraulic equipment; and the engine 40 for driving the hydraulic pump 7. The hydraulic system 200 operates according to control commands given from the controller 10.

A bleed-off section 8*b* of the control valve 8 is configured independently of a boom section 8*a* mentioned below. The bleed-off section 8*b* is connected with a supply hydraulic line 31, and is supplied with the hydraulic fluid from the hydraulic pump 7. The supply hydraulic line 31 branches into a supply hydraulic line 32 and a supply hydraulic line 33. The supply hydraulic line 33 is connected to a discharge hydraulic line 34 via a bleed-off valve 8*b*1, and the discharge hydraulic line 34 is connected to a tank 12. The bleed-off valve 8*b*1 is driven by a bleed-off solenoid proportional pressure-reducing valve 8*b*2 operating on the basis of a control input which is a command given from the controller 10, establishes communication between the supply hydraulic line 31 and the discharge hydraulic line 34, and bleeds off the hydraulic fluid from the hydraulic pump 7. On the other hand, the supply hydraulic line 32 is connected to the boom section 8*a*, and supplies the hydraulic fluid from the hydraulic pump 7 to the boom section 8*a*.

In the boom section 8*a*, the supply hydraulic line 32 is connected to the boom cylinder 4*a* via a directional control valve 8*a*1. The directional control valve 8*a*1 functions as a valve (meter-in valve) through which one of a bottom-side oil chamber 4*a*1 and a rod-side oil chamber 4*a*2 of the boom cylinder 4*a* communicates with a hydraulic line communicating with the hydraulic pump 7, and as a valve (meter-out valve) through which the other one of the bottom-side oil chamber 4*a*1 and the rod-side oil chamber 4*a*2 of the boom cylinder 4*a* communicates with a hydraulic line communicating with the tank 12. The meter-in valve 8*a*1 is driven by a directional-control-valve solenoid proportional pressure-reducing valve 8*a*2 operating based on a control input which is a command given from the controller 10, and controls the flow rate of the hydraulic fluid from the hydraulic pump 7. By driving a solenoid proportional pressure reducing valve 8*a*2*a*, the hydraulic fluid is flown from the bottom-side oil chamber 4*a*1 to the rod-side oil chamber 4*a*2. On the other hand, by driving a solenoid proportional pressure reducing valve 8*a*2*b*, the hydraulic fluid is flown from the rod-side oil chamber 4*a*2 to the bottom-side oil chamber 4*a*1. As the spool position of the meter-in valve 8*a*1 moves in the positive direction, the opening area of the meter-in valve 8*a*1 increases, and the flow rate of the hydraulic fluid to be flown therethrough increases. A cylinder position sensor 4*a*4 is attached to the boom cylinder 4*a*, and a sensor signal is transmitted to the controller 10.

In the boom section 8*a*, a pressure sensor 8*a*3 (hereinafter, a meter-in valve upstream pressure sensor) is installed before the meter-in valve 8*a*1, a pressure sensor 8*a*4 (hereinafter, a meter-in valve downstream pressure sensor) is installed after the meter-in valve 8a1, and a meter-in spool position sensor 8a5 is installed at the meter-in valve 8a1. In the pressure sensors 8a4, 8a4a functions as a meter-in valve downstream pressure sensor in a case where the bottom-side oil chamber 4a1 communicates with the hydraulic pump 7, and 8a4b functions as a meter-in valve downstream pressure sensor in a case where the rod-side oil chamber 4a2 communicates with the hydraulic pump 7. Each sensor is connected to the controller 10, and a sensor signal is transmitted to the controller 10.

The controller 10 receives inputs of a lever operation signal from the operation lever device 9a corresponding to boom-operation, a calibration mode start signal and a calibration actuator selection signal from the man-machine interface 9b mentioned below, and sensor signals of the cylinder position sensor built in the boom cylinder 4a, and the meter-in valve upstream pressure sensor 8a3, the meter-in valve downstream pressure sensor 8a4 and the meter-in spool position sensor 8a5 installed in the boom section 8a. On the basis of these signals, the directional-control-valve solenoid proportional pressure-reducing valve 8a2 and the bleed-off solenoid proportional pressure-reducing valve 8b2 are driven.

Here, the controller 10 has a normal mode for driving actuators such as the boom cylinder 4a, and a calibration mode for deriving the operation characteristics of the actuators such as the boom cylinder 4a. The man-machine interface 9b includes a switch (e.g. a manually operated push type switch) that outputs an instruction to switch the operation mode from the normal mode to the calibration mode, and an electric signal for giving an instruction to switch actuators to be calibrated.

Figure 4:
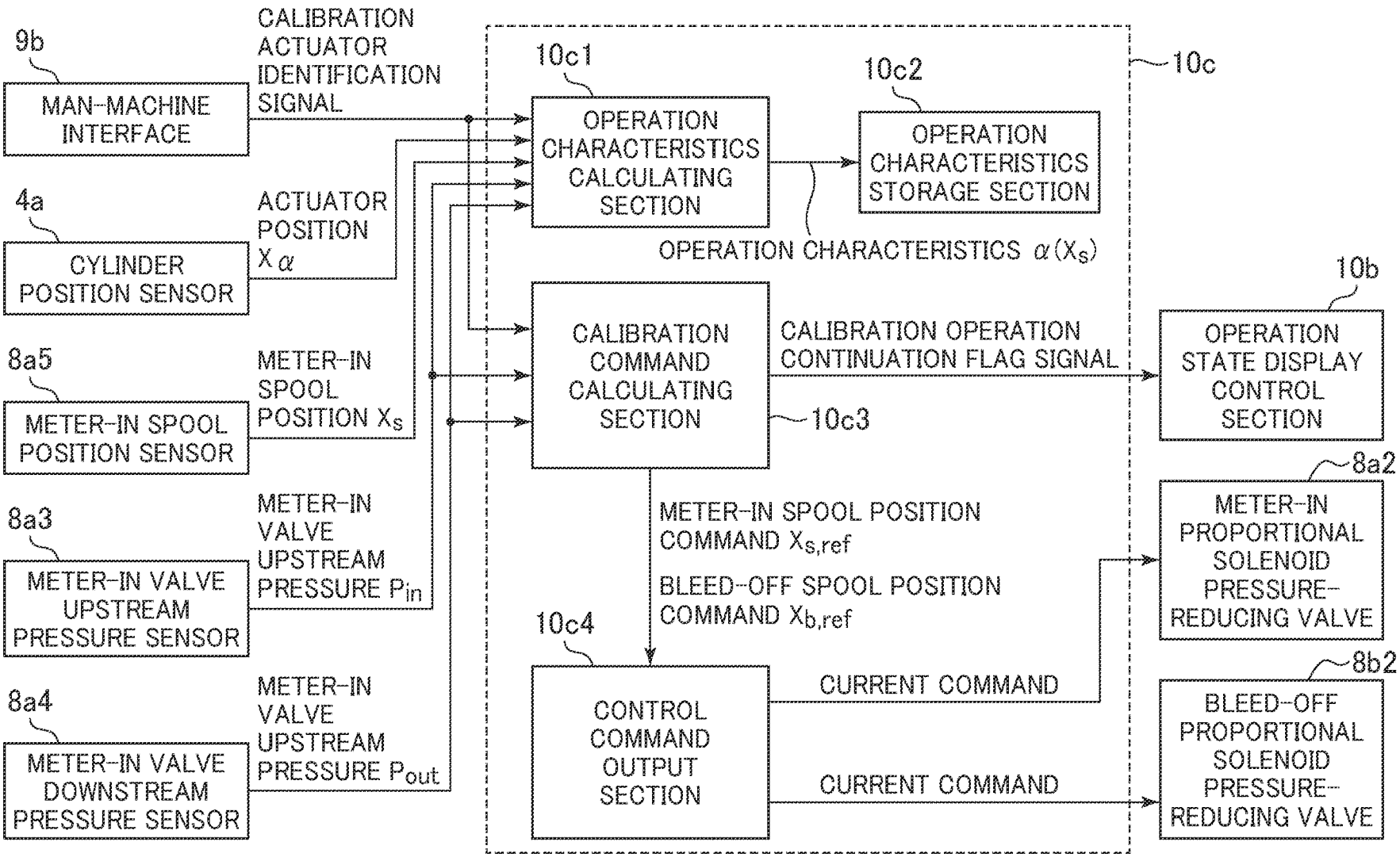
FIG. 4 is a functional block diagram representing details of a hydraulic system control section illustrated in FIG. 2.

FIG. 4 is a functional block diagram representing details of the hydraulic system control section 10c. Note that only functionalities related to the calibration operation are illustrated in FIG. 4. Explanations of other functionalities are omitted because they are not related to the present invention directly.

In FIG. 4, the hydraulic system control section 10c has an operation characteristics calculating section 10c1, an operation characteristics storage section 10c2, a calibration command calculating section 10c3, and a control command output section 10c4.

On the basis of an actuator velocity $V_a$ computed by performing numerical differentiation of an actuator position $x_a$ acquired from the cylinder position sensor 4a4, a meter-in spool position $x_s$ acquired from the meter-in spool position sensor 8a5, a meter-in valve upstream pressure $P_{in}$ acquired from the meter-in valve upstream pressure sensor 8a3, and a meter-in valve downstream pressure $P_{out}$ acquired from the meter-in valve downstream pressure sensor 8a4, the operation characteristics calculating section 10c1 calculates a relation between the meter-in spool position $x_s$ and the actuator velocity $V_a$. Here, the actuator velocity $V_a$ may be measured directly by using an Inertial Measurement Unit (IMU) or the like, without performing numerical differentiation of the actuator position $x_a$.

The relation between the meter-in spool position $x_s$ and the actuator velocity $V_a$ can be expressed by Formula (1) by using the meter-in valve upstream pressure $P_{in}$ and the meter-in valve downstream pressure $P_{out}$.

[Equation 1]

$$V_a=\alpha(x_s)\sqrt{P_{in}-P_{out}} \tag{1}$$

Here, $\alpha(x_s)$ is a monotonically increasing function of $x_s$, and is a function reflecting the relation between the meter-in spool position $x_s$ and the opening area of the meter-in valve 8a1 (opening characteristics), and the influence of the pressure loss due to the misalignment of the installation positions of the pressure sensors 8a3 and 8a4. In this document, a map of $\alpha(x_s)$ in relation to $x_s$ is defined as the operation characteristics of the actuator. The calculated operation characteristics $\alpha(x_s)$ are sent to the operation characteristics storage section 10c2 mentioned below.

Figure 5:
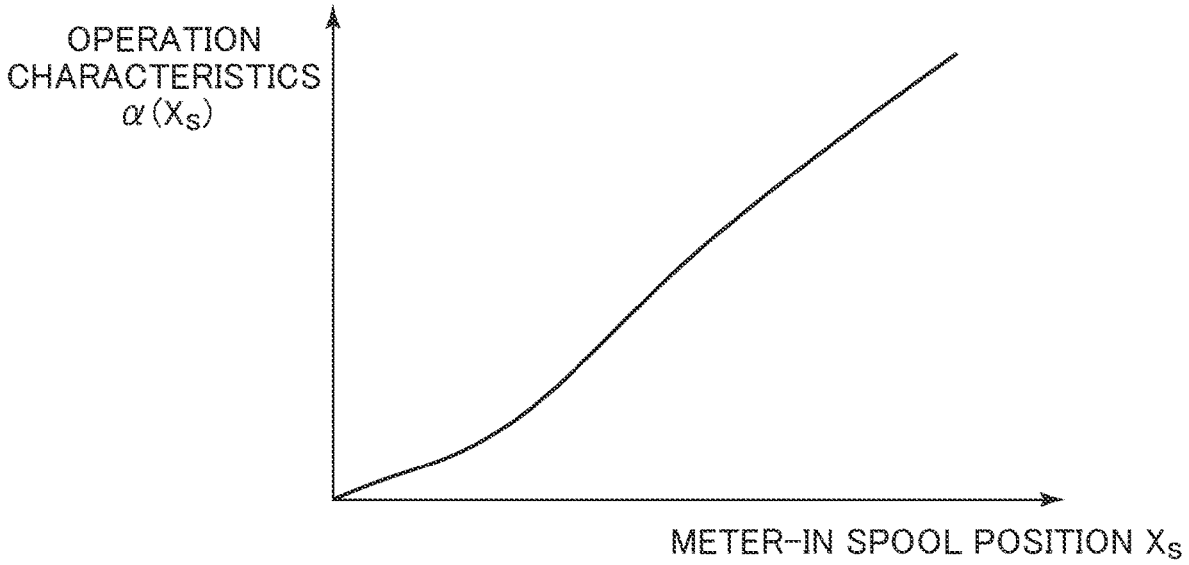
FIG. 5 is a figure illustrating one example of an operation characteristics map derived by an operation characteristics calculating section illustrated in FIG. 4.

FIG. 5 is one example of an operation characteristics map derived by the operation characteristics calculating section 10c1.

$\alpha(x_s)$ is the operation characteristics derived by the operation characteristics calculating section 10c1, and computed according to Formula (2) obtained by transposition of Formula (1).

[Equation 2]

$$\alpha(x_s) = \frac{V_a}{\sqrt{P_{in} - P_{out}}} \tag{2}$$

The operation characteristics calculating section 10c1 derives the operation characteristics map illustrated in FIG. 5 by mapping the operation characteristics $\alpha(x_s)$ in relation to the meter-in spool position $x_s$.

Returning to FIG. 4, the operation characteristics storage section 10c2 has the functionality of storing the operation characteristics $\alpha(x_s)$ sent from the operation characteristics calculating section 10c1. Every time the calibration operation is completed once and the operation characteristics $\alpha(x_s)$ derived by the operation characteristics calculating section 10c1 are sent to the operation characteristics calculating section 10c1, the operation characteristics $\alpha(x_s)$ having been stored in the operation characteristics calculating section 10c1 are updated.

On the basis of a signal that identifies an actuator to be calibrated and is input from the man-machine interface 9b, the calibration command calculating section 10c3 selects the actuator about which the operation characteristics $\alpha(x_s)$ are to be derived, and calculates a meter-in spool position command $x_{s,ref}$ for operation calibration, and a bleed-off spool position command $x_{b,ref}$ for adjusting the differential pressure across the meter-in valve 8a1. A predetermined waveform is used for the meter-in spool position command $X_{s,\ ref}$ irrespective of measurement results of sensors. The bleed-off spool position command $x_{b,ref}$ is determined on the basis of the meter-in spool position command $x_{s,ref}$, the meter-in valve upstream pressure $P_{in}$ sent from the meter-in valve upstream pressure sensor 8a3, and the meter-in valve downstream pressure $P_{out}$ sent from the meter-in valve downstream pressure sensor 8a4. Details of derivation of these position commands are mentioned below. These position commands are sent to the control command output section 10c4 mentioned below. In addition, in a case where the calibration command calculating section 10c3 is performing calculation, a signal indicating that calibration operation is continued (a calibration operation continuation flag signal) is sent to the operation state display control section 10b.

Figure 6:
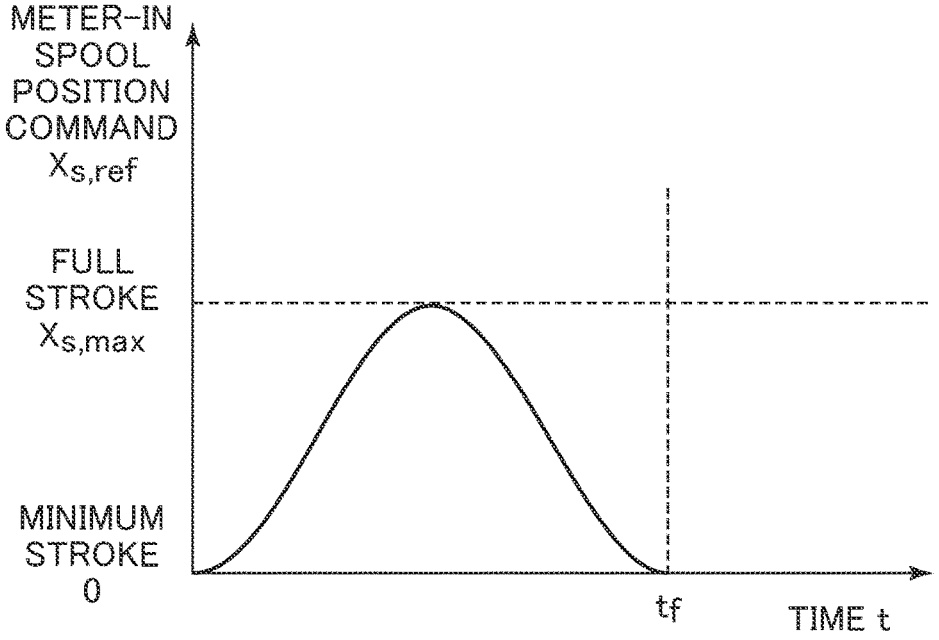
FIG. 6 is a figure illustrating one example of the command waveform of a meter-in spool position command calculated by a calibration command calculating section illustrated in FIG. 4.

FIG. 6 is a figure illustrating one example of the command waveform of the meter-in spool position command $x_{s,ref}$ calculated by the calibration command calculating section 10c3.

The command waveform of the meter-in spool position command $x_{s,ref}$ is determined in advance as time series changes from a minimum stroke (0) to a full stroke $x_{s,max}$. In the case explained here, a sine waveform like the one mentioned below is input as one example of the command waveform.

[Equation 3]

$$x_{s,ref} = 0.5x_{s,max}\sin\left(\frac{\pi}{t_f}\left(2t - \frac{t_f}{2}\right)\right) + 0.5x_{s,\max} \quad (3)$$

Here, $t_f$ is the period of the sine waveform to give commands. The command waveform may be a triangular waveform. It is assumed that the sine waveform to give commands can repetitively give commands with different phases, and the number of times of the repetitions can be selected by an operator as desired. In a case where the operation characteristics map illustrated in FIG. 5 is derived by using the least-squares method according to Formula (2), the influence of variations of measurement sensors decreases as the number of times of the repetitions of the command waveform increases, and the precision of the derivation of the operation characteristics $\alpha(x_s)$ improves.

Figure 7:
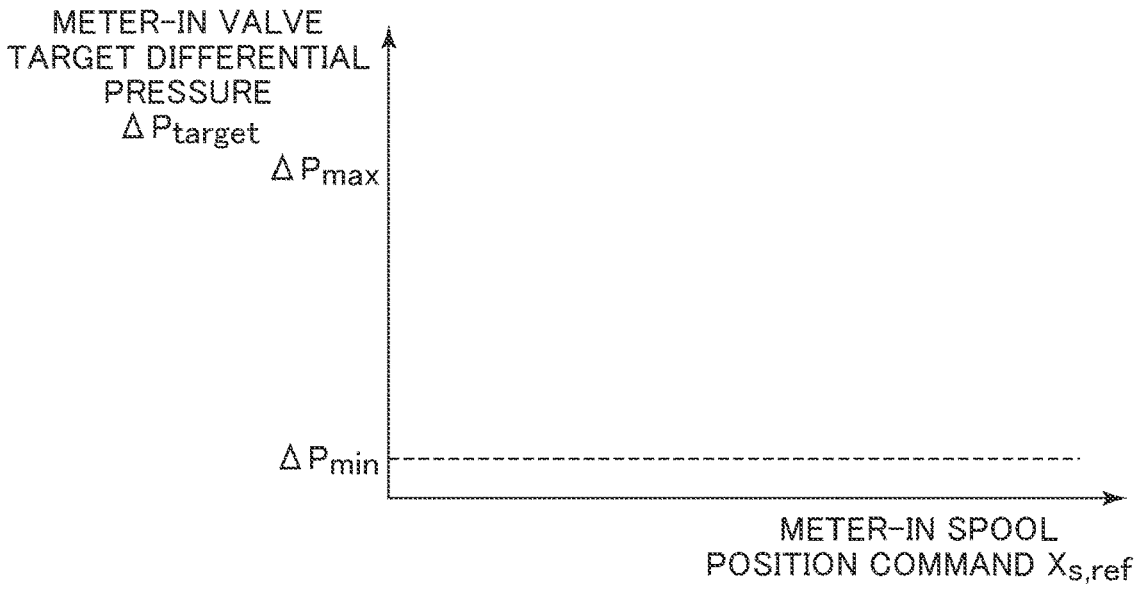
FIG. 7 is a figure illustrating one example of a command-value computation map for a bleed-off spool position command calculated by the calibration command calculating section illustrated in FIG. 4.

FIG. 7 is a figure illustrating one example of a command-value computation map for the bleed-off spool position command $x_{s,ref}$ calculated by the calibration command calculating section 10*c*3.

The bleed-off spool position command $x_{b,ref}$ is determined on the basis of the meter-in spool position command $x_{s,ref}$, the meter-in valve upstream pressure $P_{in}$ sent from the meter-in valve upstream pressure sensor 8*a*3, and the meter-in valve downstream pressure $P_{out}$ sent from the meter-in valve downstream pressure sensor 8*a*4. First, a target differential pressure $\Delta P_{target}$ across the meter-in valve 8*a*1 is determined on the basis of the map illustrated in FIG. 7 and the meter-in spool position command $x_{s,ref}$. In the map illustrated in FIG. 7, the target differential pressure $\Delta P_{target}$ across the meter-in valve 8*a*1 is mapped such that it decreases as the meter-in spool position command $x_{s,ref}$ increases. At this time, the maximum value $\Delta P_{max}$ of the target differential pressure $\Delta P_{target}$ is set to a level that is sufficient to overcome the static friction and the own weight of the actuator. Although the value of $\Delta P_{max}$ differs depending on the operation direction of the actuator, it is preferably 5 to 10 MPa. In addition, the minimum value $\Delta P_{min}$ of the target differential pressure $\Delta P_{target}$ is set to a level that is sufficient to negate measurement variations of the installed pressure sensors 8*a*3 and 8*a*4. Preferably, the value of $\Delta P_{min}$ is approximately 1 MPa. On the basis of results of the mapping, the bleed-off spool position command $x_{b,ref}$ is determined according to the following formula such that the difference between the target differential pressure $\Delta P_{target}$ across the meter-in valve and an actual differential pressure $\Delta P = P_{in} - P_{out}$ across the meter-in valve 8*a*1 measured by the meter-in valve upstream pressure sensor 8*a*3 and the meter-in valve downstream pressure sensor 8*a*4 becomes small.

[Equation 4]

$$x_{b,ref} = x_{b,pre} + K_p(\Delta P_{target} - \Delta P) \quad (4)$$

Here, $K_p$ is the feedback gain, and is an optional positive constant. $X_{b,pre}$ is a bleed-off spool position command of the previous calculation period.

Returning to FIG. 4, on the basis of the meter-in spool position command $x_{s,ref}$ and the bleed-off spool position command $x_{b,ref}$ sent from the calibration command calculating section 10*c*3, the control command output section 10*c*4 outputs current commands to the directional-control-valve solenoid proportional pressure-reducing valve 8*a*2 and the bleed-off solenoid proportional pressure-reducing valve 8*b*2. The control command output section 10*c*4 has a map used for converting each spool position command into a current command, and current command values are determined on the basis of the map.

Figure 8:
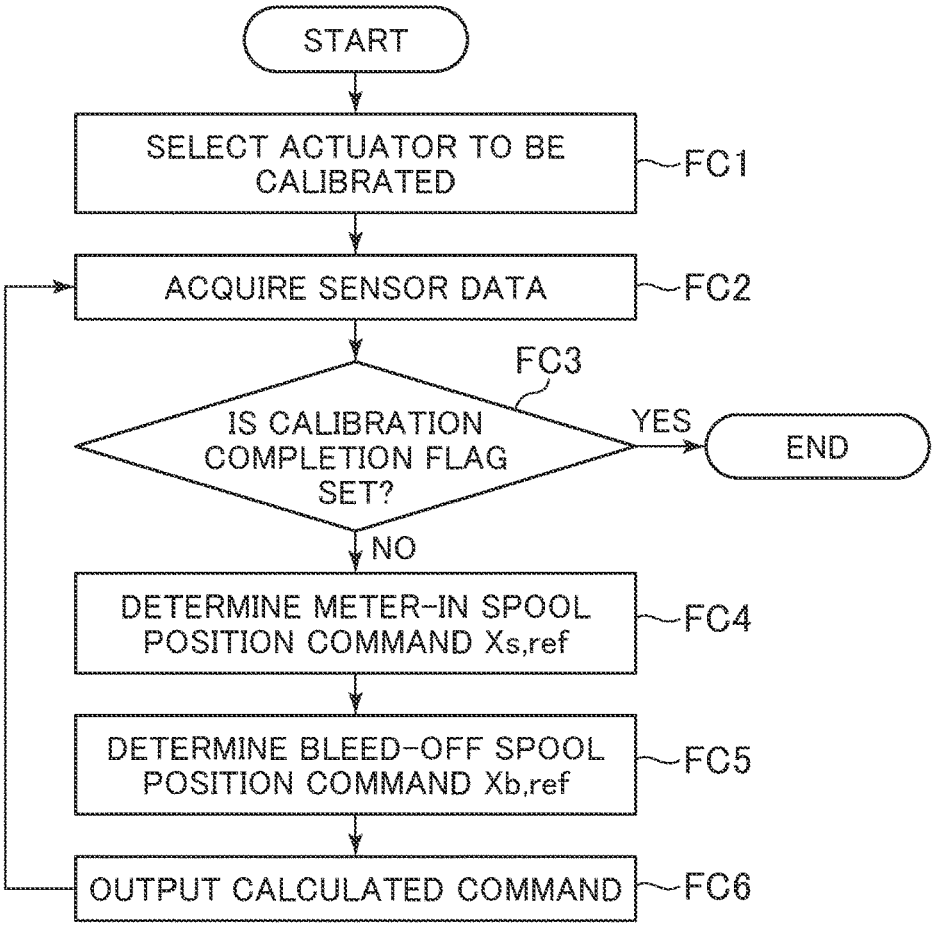
FIG. 8 is a figure illustrating a calibration command calculation flow of the hydraulic system control section in a calibration mode.

FIG. 8 is a figure illustrating a calibration command calculation flow of the hydraulic system control section 10*c* in the calibration mode.

First, at Step FC1, a signal that identifies an actuator to be calibrated and is sent from the man-machine interface 9*b* is sent to the calibration command calculating section 10*c*3, and the actuator to be calibrated is selected.

At Step FC2, the calibration command calculating section 10*c*3 acquires pressure values measured by the meter-in valve upstream pressure sensor 8*a*3 and the meter-in valve downstream pressure sensor 8*a*4.

At Step FC3, it is decided whether or not calibration operation has been completed. If calibration operation has not been completed, the process proceeds to Step FC4, and the meter-in spool position command $x_{s,ref}$ at the current time is determined on the basis of the target meter-in spool position command waveform illustrated in FIG. 6.

At Step FC5, on the basis of the command-value computation map for the bleed-off spool position command $X_{b,ref}$ illustrated in FIG. 7 and the actual differential pressure $\Delta P$ across the meter-in valve 8*a*1 measured by the meter-in valve upstream pressure sensor 8*a*3 and the meter-in valve downstream pressure sensor 8*a*4, the bleed-off spool position command $x_{b,ref}$ is determined according to Formula (4).

At Step FC6, the commands determined at Step FC4 and Step FC5 are sent to the control command output section 10*c*4, and current commands are output to the directional-control-valve solenoid proportional pressure-reducing valve 8*a*2 and the bleed-off solenoid proportional pressure-reducing valve 8*b*2.

In this manner, in the present embodiment, the hydraulic excavator 100 (construction machine) including: the engine 40 (prime mover); the tank 12 that stores the hydraulic operating fluid; the hydraulic pump 7 that is driven by the engine 40 and delivers, as a hydraulic fluid, the hydraulic operating fluid sucked in from the tank 12; the hydraulic actuator 4*a* driven by the hydraulic fluid delivered from the hydraulic pump 7; the meter-in valve 8*a*1 that adjusts the flow rate of the hydraulic fluid supplied from the hydraulic pump 7 to the hydraulic actuator 4*a*; the directional-control-valve solenoid proportional pressure-reducing valve 8*a*2 (meter-in spool position adjusting device) that adjusts the spool position $x_s$ of the meter-in valve 8*a*1; and the controller 10 that outputs the command signal to the directional-control-valve solenoid proportional pressure-reducing valve 8*a*2 according to an operation signal from the operation lever device 9*a* (operation device) includes the cylinder position sensor 4*a*4 (velocity sensor) for sensing the operation velocity $V_a$ of the hydraulic actuator 4*a*, the meter-in spool position sensor 8*a*5 (meter-in spool position sensor) that senses the spool position $x_s$ of the meter-in valve 8*a*1, the pressure sensors 8*a*3 and 8*a*4 (pressure sensors) that sense the differential pressure $\Delta P$ across the meter-in valve 8*a*1, and the bleed-off valve 8*b*1 (pressure adjusting device) and the bleed-off solenoid proportional pressure-reducing valve 8*b*2 (pressure adjusting device) that adjust the differential pressure $\Delta P$ across the meter-in valve 8*a*1. The controller 10 has the calibration mode in which the controller 10 derives the operation characteristics $\alpha(x_s)$ representing the relation among the spool position $x_s$ of the meter-in valve 8a1, the operation velocity $V_a$ of the hydraulic actuator 4a, and the differential pressure ΔP across the meter-in valve 8a1. In the calibration mode, and in a case where the spool position $x_s$ of the meter-in valve 8a1 has changed in a direction to increase the opening area of the meter-in valve 8a1, the controller 10 outputs a command signal to increase the opening area of the bleed-off valve 8b1 to the bleed-off solenoid proportional pressure-reducing valve 8b2 as a command signal to reduce the differential pressure ΔP across the meter-in valve 8a1. Thereby, the flow rate of the hydraulic fluid discharged from the hydraulic pump 7 to the tank 12 increases, and the upstream pressure $P_{in}$ of the meter-in valve 8a1 lowers to reduce the differential pressure ΔP.

According to the hydraulic excavator 100 according to the thus-configured present embodiment, the following effects are attained.

Figure 9:
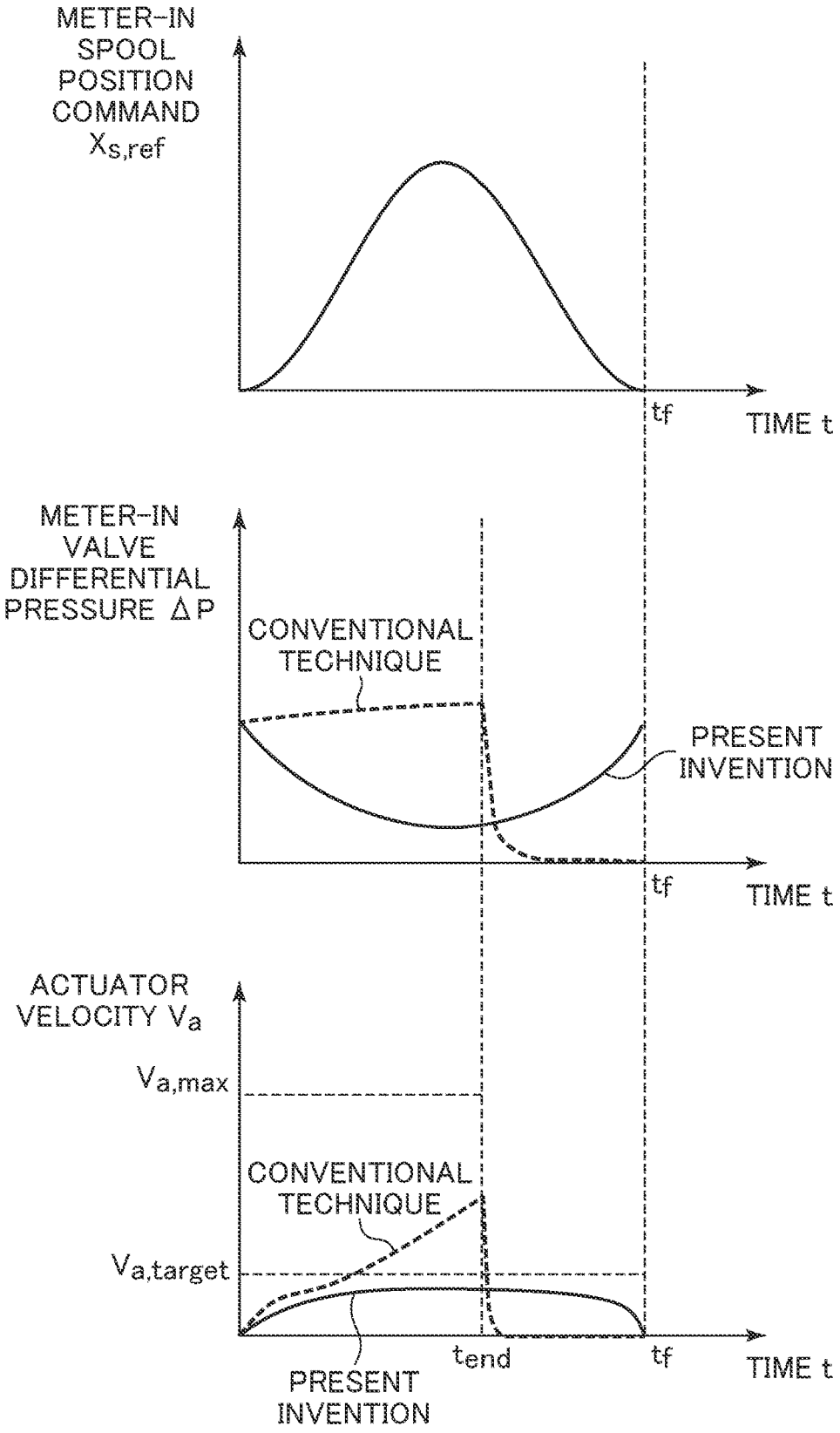
FIG. 9 is a figure illustrating changes in the meter-in spool position command, the differential pressure across a meter-in valve and an actuator velocity in the calibration mode.

FIG. 9 is a figure illustrating changes in the meter-in spool position command $x_{s,ref}$, the differential pressure ΔP across the meter-in valve 8a1, and the actuator velocity $V_a$ in the calibration mode.

For the meter-in spool position command $x_{s,ref}$ for one reciprocating movement given as a command for calibration operation, the bleed-off spool position command $x_{b,ref}$ is determined according to Formula (4) on the basis of the command-value computation map for the bleed-off spool position command $x_{b,ref}$, and the actual differential pressure ΔP across the meter-in valve 8a1. Thereby, the differential pressure ΔP across the meter-in valve 8a1 like the one illustrated in FIG. 9 is obtained, and increase in the actuator velocity $V_a$ is suppressed. That is, as compared with conventional techniques in which the differential pressure ΔP across the meter-in valve 8a1 is not adjusted during calibration operation, the meter-in spool can be operated in a state in which the actuator velocity $V_a$ is kept low in the present invention. The actuator velocity $V_a$ at this time is adjusted, by using a target velocity $V_{a,target}$ indicated by Formula (5) as a reference, as a velocity at which the limit of a movable range $L_a$ of the actuator is not exceeded in the period $t_f$ of the meter-in spool position command.

[Equation 5]

$$V_{a,target} = \frac{L_a}{t_f} \tag{5}$$

As a result, the spool of the meter-in valve 8a1 can be caused to make one reciprocating movement in the movable range of the actuator 4a, and measurement data of the entire calibration area can be acquired with the calibration operation performed once. Accordingly, the time efficiency of the operation calibration is improved. In conventional techniques, the limit of the maximum movable range of the actuator is reached at a time $t_{end}$ before the velocity of the actuator reaches the maximum velocity $V_{a,max}$ of the actuator necessary for calibration. Accordingly, the calibration cannot be completed by performing the operation only once, and the calibration operation needs to be performed multiple times with different patterns of the meter-in spool position command $x_{s,ref}$.

Figure 10:
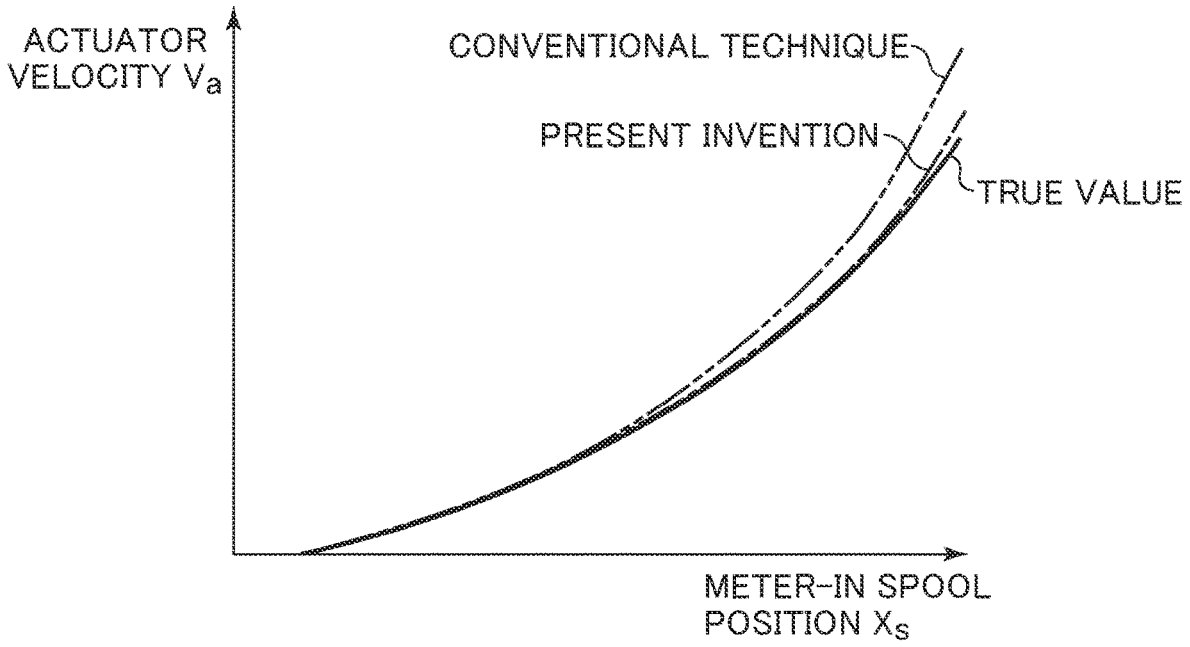
FIG. 10 is a figure illustrating one example of operation characteristics derivation results in the first embodiment of the present invention.

FIG. 10 is a figure illustrating one example of operation characteristics derivation results in the present embodiment.

The graph in FIG. 10 illustrates results of mapping the actuator velocity $V_a$ relative to the meter-in spool position $x_{s,ref}$ in the present embodiment in comparison with supposed true values, and mapping results in a conventional technique in which the differential pressure ΔP across the meter-in valve 8a1 is not adjusted at the time of calibration operation. Mapping results of the present invention are obtained by assigning, in Formula (1), the operation characteristics $\alpha(x_{s,ref})$ relative to the meter-in spool position $x_{s,ref}$ computed by using the operation characteristics $\alpha(x_s)$ illustrated in FIG. 5, and the meter-in valve upstream pressure $P_{in}$ and meter-in valve downstream pressure $P_{out}$ relative to the meter-in spool position $X_{s,ref}$, and computing the actuator velocity $V_a$ relative to the meter-in spool position $x_{s,ref}$.

In the present invention, as can be known from the relation indicated by Formula (1), by adjusting the actual differential pressure ΔP across the meter-in valve 8a1 at the time of calibration operation, data for deriving the operation characteristics is measured in a state in which the actuator velocity $V_a$ is kept low. Thereby, the influence of the inertia and the viscous resistance of the hydraulic fluid that increase in proportion to the actuator velocity $V_a$ is suppressed, and calibration results that are closer to true values can be obtained in an area where the opening area of the meter-in valve 8a1 is large, that is, in a high-velocity area of the actuator velocity $V_a$ as compared with conventional techniques. Accordingly, the calibration precision is improved. That is, it becomes possible to precisely derive the operation characteristics $\alpha(x_s)$ of the hydraulic actuator in the high-velocity area with less calibration operation.

In the cases that are explained in the following embodiments, means other than the bleed-off circuit are used as pressure adjusting devices that adjust the differential pressure ΔP across the meter-in valve 8a1.

Second Embodiment

A second embodiment of the present invention, mainly differences of the second embodiment from the first embodiment, is explained.

Figure 11:
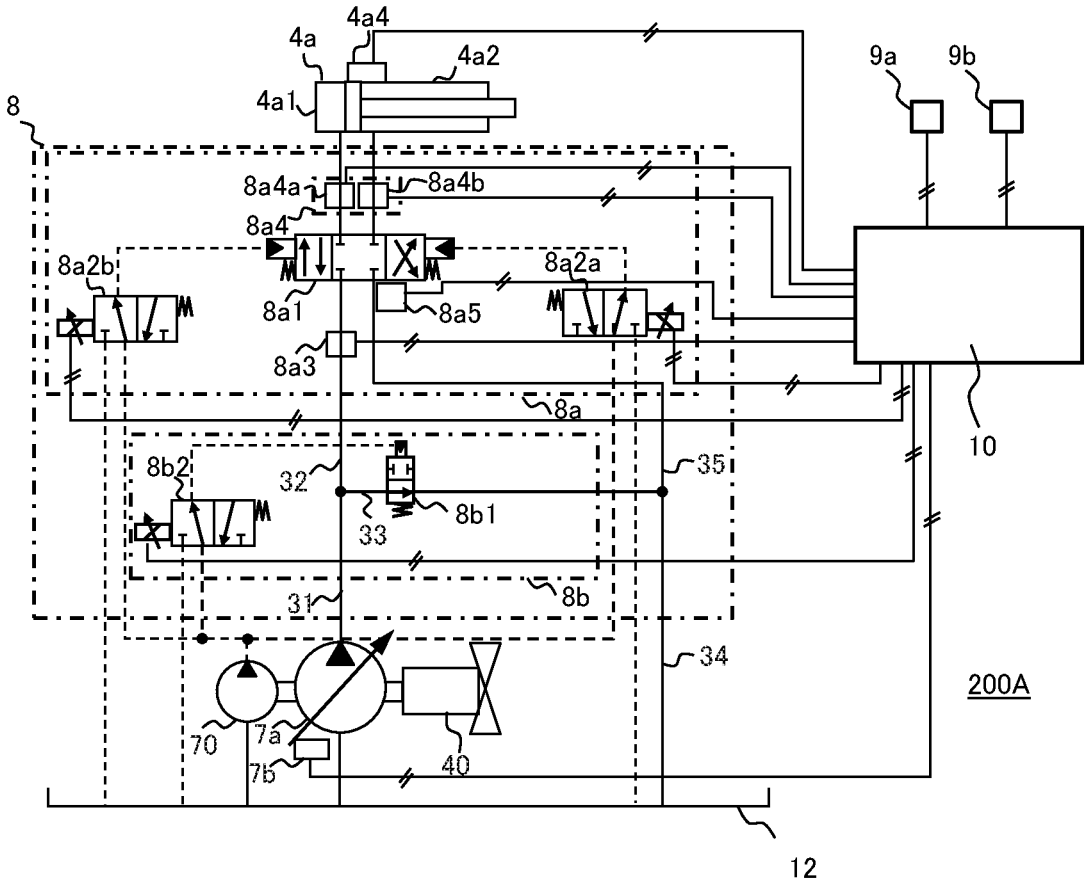
FIG. 11 is a schematic diagram of the hydraulic system mounted on the hydraulic excavator according to a second embodiment of the present invention.

FIG. 11 is a schematic diagram of the hydraulic system mounted on the hydraulic excavator 100 according to the present embodiment.

In FIG. 11, a hydraulic system 200A in the present embodiment has a variable displacement hydraulic pump 7a, and the controller 10 controls the flow rate of the hydraulic fluid supplied from the hydraulic pump 7a to meter-in valve 8a1, and thereby adjusts the upstream pressure $P_{in}$ of the meter-in valve 8a1.

In this manner, in the present embodiment, the hydraulic pump 7a is a variable displacement hydraulic pump, and the pressure adjusting device that adjusts the differential pressure ΔP across the meter-in valve 8a1 is a regulator 7b that adjusts the delivery flow rate of the hydraulic pump 7a. In a case where the spool position $x_s$ of the meter-in valve 8a1 has changed in the direction to increase the opening area of the meter-in valve 8a1 in the calibration mode, the controller 10 outputs a command signal to reduce the delivery flow rate of the hydraulic pump 7a to the regulator 7b as the command signal to reduce the differential pressure ΔP across the meter-in valve 8a1. Thereby, the flow rate of the hydraulic fluid supplied from the hydraulic pump 7a to the meter-in valve 8a1 decreases, and the upstream pressure $P_{in}$ of the meter-in valve 8a1 lowers to reduce the differential pressure ΔP.

In the hydraulic excavator 100 thus-configured according to the present embodiment also, effects similar to those in the first embodiment are attained.

In addition, by adjusting the upstream pressure $P_{in}$ of the meter-in valve 8a1 by the supply flow rate control of the variable displacement hydraulic pump 7*a*, the flow rate of the hydraulic fluid to be wastefully discharged at the time of calibration operation decreases. Accordingly, the energy efficiency is improved. In addition, the upstream pressure $P_{in}$ of the meter-in valve 8*a*1 can be controlled without changing the revolution speed of the engine 40, and thus it becomes possible to suppress the influence on the entire operation of the hydraulic excavator 100.

Third Embodiment

A third embodiment of the present invention, mainly differences of the third embodiment from the first embodiment, is explained.

Figure 12:
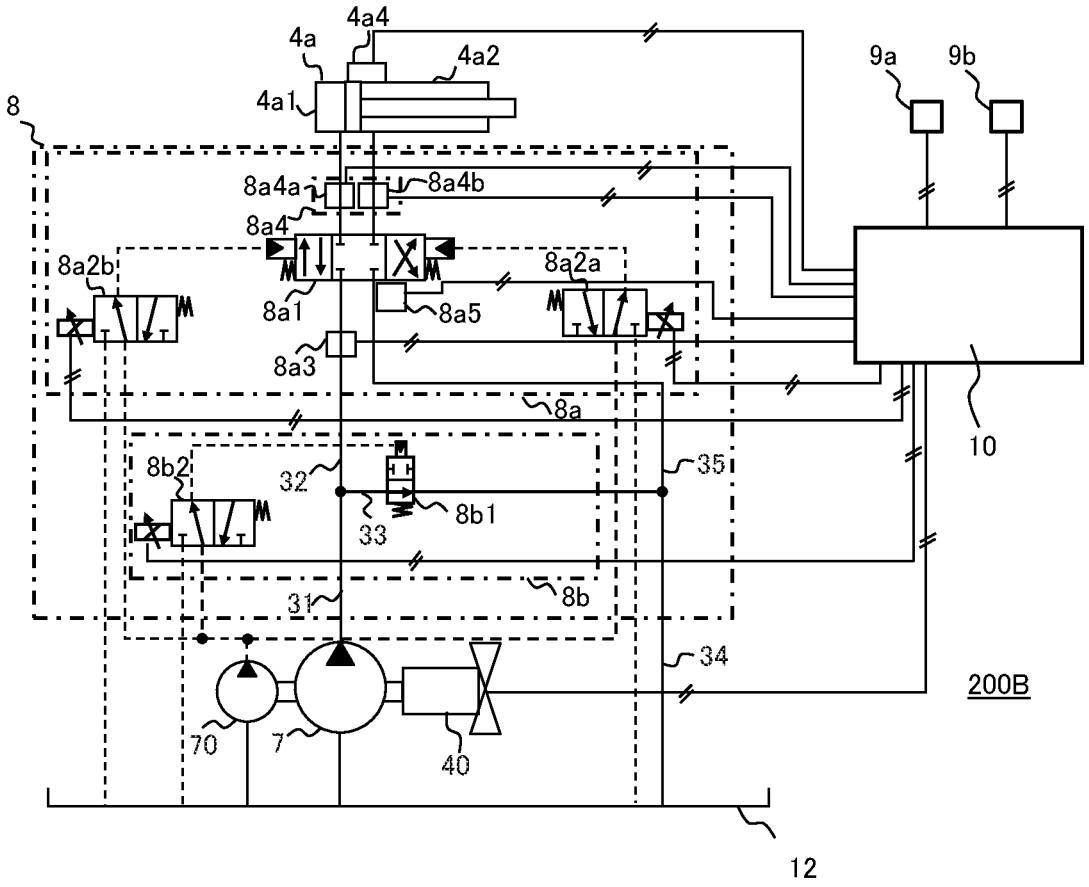
FIG. 12 is a schematic diagram of the hydraulic system mounted on the hydraulic excavator according to a third embodiment of the present invention.

FIG. 12 is a schematic diagram of the hydraulic system mounted on the hydraulic excavator 100 according to the present embodiment.

In FIG. 12, in a hydraulic system 200B in the present embodiment, the controller 10 is given the functionality of controlling the revolution speed of the engine 40, and by controlling the revolution speed of the engine 40, the flow rate of the hydraulic fluid supplied from the hydraulic pump 7 to the meter-in valve 8*a*1 is controlled.

In this manner, in the present embodiment, the pressure adjusting device that adjusts the differential pressure ΔP across the meter-in valve 8*a*1 is the engine 40 (prime mover). In a case where the spool position $x_s$ of the meter-in valve 8*a*1 has changed in the direction to increase the opening area of the meter-in valve 8*a*1 in the calibration mode, the controller 10 outputs a command signal to lower the revolution speed of the engine 40 to the engine 40 as the command signal to reduce the differential pressure ΔP across the meter-in valve 8*a*1. Thereby, the flow rate of the hydraulic fluid supplied from the hydraulic pump 7 to the meter-in valve 8*a*1 decreases, and the upstream pressure $P_{in}$ of the meter-in valve 8*a*1 lowers to reduce the differential pressure ΔP.

In the hydraulic excavator 100 according to the thus-configured present embodiment also, effects similar to those in the first embodiment are attained.

In addition, the upstream pressure $P_{in}$ of the meter-in valve 8*a*1 can be adjusted by controlling the supply hydraulic fluid flow rate. By adjusting the upstream pressure $P_{in}$ of the meter-in valve 8*a*1 by the revolution speed control of the engine 40, the flow rate of the hydraulic fluid to be wastefully discharged at the time of calibration operation decreases. Accordingly, the energy efficiency is improved. In addition, it becomes possible to control the upstream pressure $P_{in}$ of the meter-in valve 8*a*1 also in a case where the hydraulic pump 7 used is a fixed displacement hydraulic pump.

Fourth Embodiment

A fourth embodiment of the present invention, mainly differences of the fourth embodiment from the first embodiment, is explained.

Figure 13:
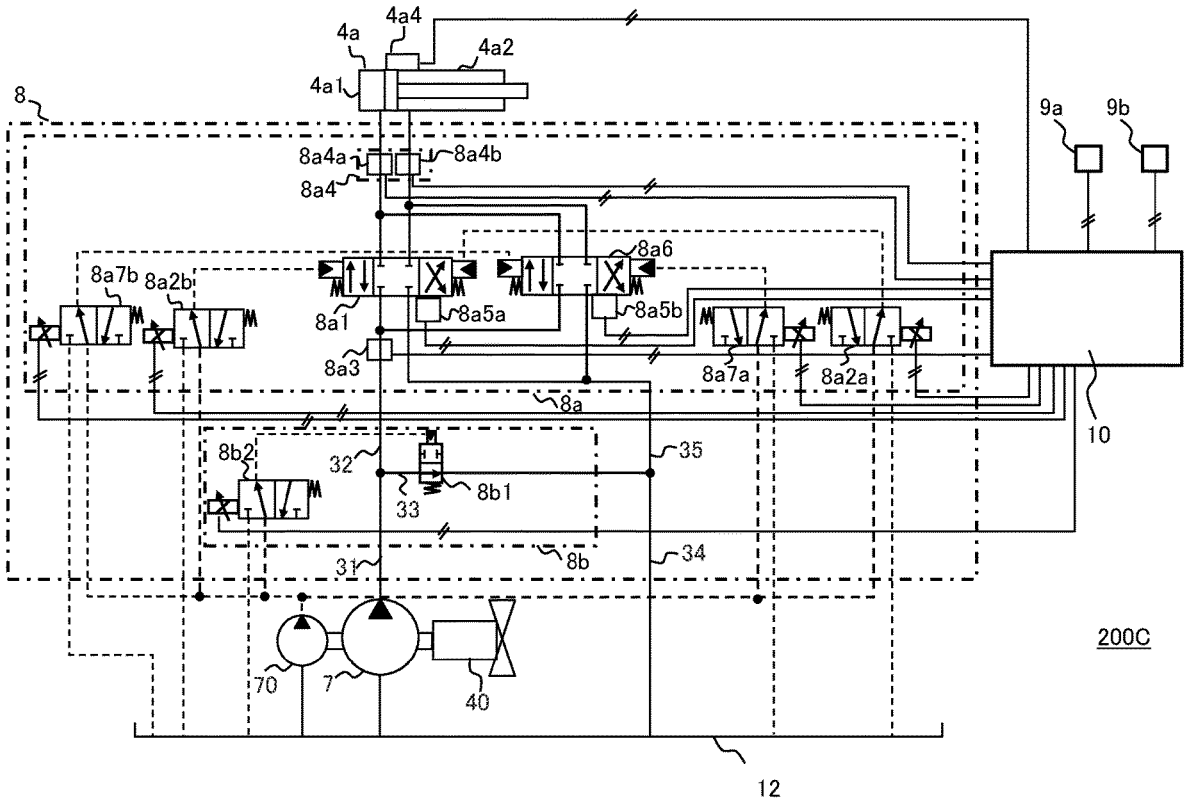
FIG. 13 is a schematic diagram of the hydraulic system mounted on the hydraulic excavator according to a fourth embodiment of the present invention.

FIG. 13 is a schematic diagram of the hydraulic system mounted on the hydraulic excavator 100 according to the present embodiment.

In FIG. 13, a hydraulic system 200C in the present embodiment has, in the boom section 8*a*, a directional control valve 8*a*6 which is independent of the directional control valve 8*a*1. Similar to the directional control valve 8*a*1, the directional control valve 8*a*6 functions as a valve (meter-in valve) through which one of the bottom-side oil chamber 4*a*1 and the rod-side oil chamber 4*a*2 of the boom cylinder 4*a* communicates with the hydraulic line communicating with the hydraulic pump 7, and as a valve (meter-out valve) through which the other one of the bottom-side oil chamber 4*a*1 and the rod-side oil chamber 4*a*2 of the boom cylinder 4*a* communicates with the hydraulic line communicating with the tank 12. In a case where the directional control valve 8*a*1 is functioning as a meter-in valve, the directional control valve 8*a*6 functions as a meter-out valve, and in a case where the directional control valve 8*a*6 is functioning as a meter-in valve, the directional control valve 8*a*1 functions as a meter-out valve. In addition, in a case where the directional control valve 8*a*1 is functioning as a meter-in valve, a spool position sensor 8*a*5*a* functions as the meter-in spool position sensor 8*a*5 that measures the meter-in spool position, and in a case where the directional control valve 8*a*6 is functioning as a meter-in valve, a spool position sensor 8*a*5*b* functions as the meter-in spool position sensor 8*a*5 that measures the meter-in spool position. The directional control valve 8*a*6 is driven by a directional-control-valve proportional solenoid pressure-reducing valve 8*a*7 being operated based on a control input given as a command from the controller 10. The flow rate of the hydraulic fluid to be discharged from the boom cylinder 4*a* to the tank 12 is controlled by the operation of the meter-out valve 8*a*6 or 8*a*1, and thereby the downstream pressure $P_{out}$ of the meter-in valve 8*a*1 or 8*a*6 is adjusted.

In this manner, in the present embodiment, the pressure adjusting device that adjusts the differential pressure ΔP across the meter-in valve 8*a*1 or 8*a*6 has the meter-out valve 8*a*6 or 8*a*1 provided independently of the meter-in valve 8*a*1 or 8*a*6 and adjusting the flow rate of the hydraulic fluid discharged from the hydraulic actuator 4*a* to the tank 12, and has the directional-control-valve proportional solenoid pressure-reducing valve 8*a*7 or 8*a*2 controlling the opening area of the meter-out valve 8*a*6 or 8*a*1. In a case where the spool position $x_s$ of the meter-in valve 8*a*1 or 8*a*6 has changed in a direction to increase the opening area of the meter-in valve 8*a*1 or 8*a*6 in the calibration mode, the controller 10 outputs a command signal to reduce the opening area of the meter-out valve 8*a*6 or 8*a*1 to the directional-control-valve proportional solenoid pressure-reducing valve 8*a*7 or 8*a*2 as a command signal to reduce the differential pressure ΔP across the meter-in valve 8*a*1 or 8*a*6. Thereby, the flow rate of the hydraulic fluid discharged from the hydraulic actuator 4*a* to the tank 12 decreases, and the downstream pressure $P_{out}$ of the meter-in valve 8*a*1 or 8*a*6 increases to lower the differential pressure ΔP.

In the hydraulic excavator 100 thus-configured according to the present embodiment also, effects similar to those in the first embodiment are attained.

In addition, due to the control of the meter-out valve 8*a*6 or 8*a*1, the downstream pressure $P_{out}$ of the meter-in valve 8*a*1 or 8*a*6 can be precisely adjusted, and the hydraulic actuator 4*a* is effectively prevented from leaping due to gravity or inertia, thereby allowing the enhancement of the measurement precision of the actuator velocity $V_a$.

Although embodiments of the present invention have been mentioned in detail thus far, the present invention is not limited to the embodiments described above, and includes various modification examples. For example, the embodiments described above are explained in detail in order to explain the present invention in an easy-to-understand manner, and embodiments of the present invention are not necessarily limited to those including all the configurations explained.

In addition, it is also possible to add some of the configurations of an embodiment to the configurations of another embodiment, it is possible to remove some of the configurations of an embodiment, or it is also possible to replace some of the configurations of an embodiment with some of the configurations of another embodiment.

DESCRIPTION OF REFERENCE CHARACTERS

1: Front device
2: Upper swing structure
2*a*: Swing motor (hydraulic actuator)
3: Lower track structure
4: Boom
4*a*: Boom cylinder (hydraulic actuator)
4*a*1: Bottom-side oil chamber
4*a*2: Rod-side oil chamber
4*a*4: Cylinder position sensor (velocity sensor)
5: Arm
5*a*: Arm cylinder (hydraulic actuator)
6: Bucket
6*a*: Bucket cylinder (hydraulic actuator)
7, 7*a*: Hydraulic pump
7*b*: Regulator
8: Control valve
8*a*: Boom section
8*a*1: Meter-in valve
8*a*2: Directional-control-valve solenoid proportional pressure-reducing valve (meter-in spool position adjusting device)
8*a*3: Meter-in valve upstream pressure sensor (pressure sensor)
8*a*4: Meter-in valve downstream pressure sensor (pressure sensor)
8*a*5: Meter-in spool position sensor (meter-in spool position sensor)
8*a*6: Meter-out valve (pressure adjusting device)
8*a*7: Directional-control-valve proportional solenoid pressure-reducing valve 8*a*7 (pressure adjusting device)
8*b*: Bleed-off section
8*b*1: Bleed-off valve (pressure adjusting device)
8*b*2: Bleed-off solenoid proportional pressure-reducing valve (pressure adjusting device)
9: Cab
9*a*: Operation lever device (operation device)
10: Controller
11: Design data
12: Tank
31 to 33: Supply hydraulic line
34, 35: Discharge hydraulic line
40: Engine (pressure adjusting device)
50: Relief valve
100: Hydraulic excavator (construction machine)

The invention claimed is:

1. A construction machine comprising:
a prime mover;
a tank that stores a hydraulic operating fluid;
a hydraulic pump that is driven by the prime mover and delivers, as a hydraulic fluid, the hydraulic operating fluid sucked in from the tank;
a hydraulic actuator that is driven by the hydraulic fluid delivered from the hydraulic pump;
a meter-in valve that adjusts a flow rate of the hydraulic fluid supplied from the hydraulic pump to the hydraulic actuator;
a meter-in spool position adjusting device that adjusts a spool position of the meter-in valve; and
a controller that outputs a command signal to the meter-in spool position adjusting device, wherein
the construction machine includes:
a velocity sensor for sensing an operation velocity of the hydraulic actuator;
a meter-in spool position sensor that senses the spool position of the meter-in valve;
a pressure sensor that senses a differential pressure across the meter-in valve; and
a pressure adjusting device that adjusts the differential pressure across the meter-in valve, and
the controller has a calibration mode in which the controller derives operation characteristics that represent a relation among the spool position of the meter-in valve, the operation velocity of the hydraulic actuator, and the differential pressure across the meter-in valve, and
is configured to, in a case where the spool position of the meter-in valve has changed in a direction to increase an opening area of the meter-in valve in the calibration mode, output a command signal to reduce the differential pressure across the meter-in valve to the pressure adjusting device such that increase in the flow rate of the hydraulic fluid to be flown into the meter-in valve is suppressed.

2. The construction machine according to claim 1, wherein
the pressure adjusting device includes a bleed-off valve that adjusts the flow rate of the hydraulic fluid discharged from the hydraulic pump to the tank, and a bleed-off solenoid valve that controls an opening area of the bleed-off valve, and
the controller is configured to, in a case where the spool position of the meter-in valve has changed in the direction to increase the opening area of the meter-in valve in the calibration mode, output a command signal to increase the opening area of the bleed-off valve to the bleed-off solenoid valve as the command signal to reduce the differential pressure across the meter-in valve.

3. The construction machine according to claim 1, wherein
the hydraulic pump is a variable displacement hydraulic pump,
the pressure adjusting device is a regulator that adjusts a delivery flow rate of the hydraulic pump, and
the controller is configured to, in a case where the spool position of the meter-in valve has changed in the direction to increase the opening area of the meter-in valve in the calibration mode, output a command signal to reduce the delivery flow rate of the hydraulic pump to the regulator as the command signal to reduce the differential pressure across the meter-in valve.

4. The construction machine according to claim 1, wherein
the pressure adjusting device is the prime mover, and
the controller is configured to, in a case where the spool position of the meter-in valve has changed in the direction to increase the opening area of the meter-in valve in the calibration mode, output a command signal to lower a revolution speed of the prime mover to the prime mover as the command signal to reduce the differential pressure across the meter-in valve.

5. The construction machine according to claim 1, wherein
the pressure adjusting device is provided independently of the meter-in valve, and includes a meter-out valve that adjusts the flow rate of the hydraulic fluid discharged from the hydraulic actuator to the tank, and a meter-out solenoid valve that controls an opening area of the meter-out valve, and the controller is configured to, in a case where the spool position of the meter-in valve has changed in the direction to increase the opening area of the meter-in valve in the calibration mode, output a command signal to reduce the opening area of the meter-out valve to the meter-out solenoid valve as the command signal to reduce the differential pressure across the meter-in valve.

* * * * *